US005447458A

United States Patent [19]

Grenesko et al.

[11] Patent Number: 5,447,458

[45] Date of Patent: Sep. 5, 1995

[54] WATER SKIING INSTRUCTIONAL DEVICE AND METHOD FOR USE

[75] Inventors: Ronald L. Grenesko; Philip J. Moses, both of Pittsburgh, Pa.

[73] Assignee: Their Futures, Inc., Pittsburgh, Pa.

[21] Appl. No.: 184,240

[22] Filed: Jan. 19, 1994

[51] Int. Cl.[6] ..... A63C 11/10

[52] U.S. Cl. ..... 441/69; 441/73

[58] Field of Search ..... 441/68, 69, 73; 114/253; 434/253

[56] References Cited

U.S. PATENT DOCUMENTS 3,125,060 3/1964 Leonard ..... 441/73

3,604,388 9/1971 Brown et al. ..... 441/69

4,060,049 11/1977 Rumbaugh ..... 441/69

*Primary Examiner*—Sherman Basinger

*Attorney, Agent, or Firm*—Daniel J. Long

[57] ABSTRACT

Disclosed is a water skiing instructional device which includes a forward ski retaining member having a ski pivoting surface, a rearward handle member, and a rigid longitudinal support member connecting the forward ski retaining member and the rearward handle member which may be used to assist a beginning skier in progressing from an initial semi-submerged stationary starting position to a generally upright skiing position. A method of using the device is also disclosed.

13 Claims, 2 Drawing Sheets

WATER SKIING INSTRUCTIONAL DEVICE AND METHOD FOR USE

BACKGROUND OF THE INVENTION

1. Field of the Invention

This invention relate to equipment for use in sporting and athletic activities and more particularly to water skiing equipment.

2. Brief Description of the Prior Art

Over recent decades the sport of water skiing has experienced a rapid growth in popularity. It is a sport which may be enjoyed by a wide range of age groups, and which affords many families the opportunity to engage in a vigorous outdoor activity which all members enjoy. It is found, however, that many beginning skiers, while enjoying the skiing itself, may have difficulty being able to consistently gain an upright skiing position from the conventional semi-submerged starting position. This difficulty often results from the inability of the beginning skier to maintain his skis in a parallel position which may stem from the lack of upper or lower body strength or dexterity on the part of such beginning skiers, particularly in the case of younger skiers. Because of this often temporary condition, such beginning skiers may become discouraged with the sport altogether or their progress and enjoyment of it may be retarded by many years.

It is, therefore, the object of the present invention to provide a inexpensively manufactured and durable instructional device and method for its use which will enable beginning skiers to easily and safely attain an upright water skiing position from the conventional semi-submerged starting position.

SUMMARY OF THE INVENTION

The device of the present invention is a water skiing instructional device which includes a forward ski retaining member having a ski pivoting surface, a rearward handle member, and a rigid longitudinal support means connecting the forward ski retaining member and the rearward handle member. Preferably the ski pivoting surface is convexly shaped so to be adapted so that a water ski may be easily pivoted on it. Preferably the ski retaining member is comprised of a rigid front bar having a rear surface which forms the ski pivoting surface and a rigid recessed bar member. Also encompassed within the invention is a method of using the device to assist a skier in progressing from an initial semi-submerged starting position to a generally upright skiing position.

BRIEF DESCRIPTION OF THE DRAWINGS

The present invention is further described with reference to the accompanying drawings in which.

DETAILED DESCRIPTION

Figure 2:
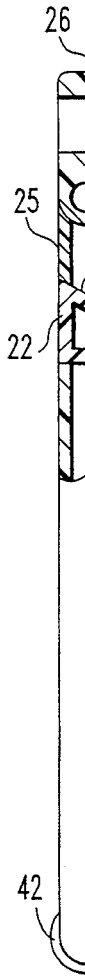
FIG. 2 is a side view of the water skiing instructional device shown in FIG. 1 which is shown partially in section a line II—II of FIG. 1.
Figure 1:
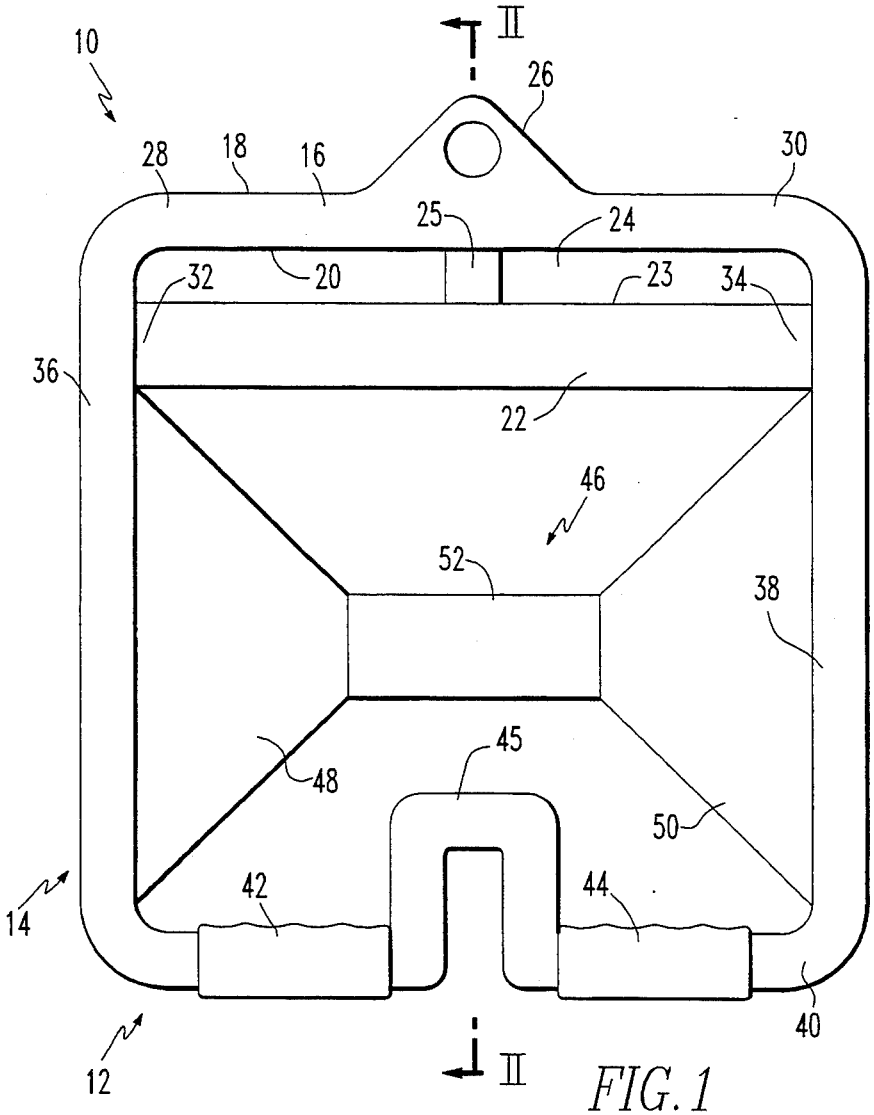
FIG. 1 is a plan view of the water skiing instructional device of the present invention.

Referring to FIGS. 1 and 2, the device for use in training water skiers of the present invention generally comprises a forward ski retaining member shown generally at numeral 10, a rearward handle member shown generally at numeral 12 and a rigid longitudinal support connecting the forward ski retaining member and the rearward handle member shown generally at numeral 14. The rigid longitudinal support means will be adapted in length to be comfortably used by prospective users and will preferably be from about 20 inches to about 36 inches in length and more preferably 24 inches. It will be seen that the ski retaining member is comprised of a rigid transverse front bar 16 having a front surface 18 and a rear surface 20 which rear surface forms the ski pivoting surface. This ski pivoting surface is convex in shape to be adapted to allow a water ski to be pivoted through a vertical arc on it. The ski retaining member also includes a rigid transverse recessed bar 22 having a sloped side 23 that is longitudinally displaced behind the rigid front bar to form with the rigid front bar a ski retaining slot 24. A rigid reinforcement 25 extends across the retaining slot between the front bar and the recessed bar. Means for exerting a forwardly directed force on the forward ski retaining member are also provided which may be a conventional ski line extending from a power boat (not shown) attached to a ski line connecting ring 26 which extends forwardly from the front surface of the rigid front bar. It will also be seen that the rigid front bar has a first and second lateral end 28 and 30 and the rigid recessed bar also has a first and second lateral end 32 and 34. The rigid longitudinal support means comprises a first lateral bar 36 and a second lateral bar 38 which first lateral bar extends rearwardly from the first lateral side of the rigid front bar to the first lateral side of the recessed bar to the handle means and the second lateral bar extends from the second lateral end of the rigid front bar to the second lateral end of the recessed bar to the handle member. It will be further observed that the handle member is comprised of a rigid handle bar 40 transversely extending between the first lateral bar and the second lateral bar and a pair of bicycle grips 42 and 44. Between these grips there is a indented section 45 in the handle. The device also includes a transverse reinforcing member shown generally at numeral 46 which is medially positioned between the recessed bar and the handle member and extends between the first lateral bar and the second lateral bar. This reinforcing member comprises a first flattened trapezoidally shaped member 48 and a second flattened trapezoidially shaped member 50 which extend inwardly toward each other respectfully from the first and second lateral bars and which are connected by a centrally positioned flattened rectangular member 52.

The front bar and the first and second lateral bars and the handle member bar are tubular in shape. In the illustrated embodiment the recessed bar is also tubular in shape. Preferably the front bar, the recessed bar and the first and second lateral bars and the handle member bar have an outer diameter of from about 1 inch to about 2 inches and a inner diameter of from about $\frac{3}{4}$ inch to about $1\frac{1}{2}$ inch and more preferably have an outer diameter of $1\frac{1}{4}$ inches and an inner diameter of $\frac{3}{4}$ inch. These members may be tubular plastic preferably high density polyethylene or alternatively tubular aluminum. When tubular aluminum is used, the front bar, lateral bars and handle bar may be formed from a single piece of tubular aluminum shaped into a generally rectangular shape and connected end to end. The recessed bar may be wood which is bolted at its lateral ends to the lateral bars at an appropriate distance behind the front bar. The use of the medial reinforcing member may be particularly useful when tubular plastic is used for the front lateral and handle, and this medial reinforcing member will preferably be solid plastic having a thickness of from about ½ inch to about 1½. The ski retaining slot will have a transverse dimension which will accommodate either one or two pairs of water skis and will preferably be from about 16 to 48 inches and more preferably be about 20 inches and will have a longitudinal dimension of from about ½ inch to about 1½ inches and more preferably about ¾ inches.

Figure 3:
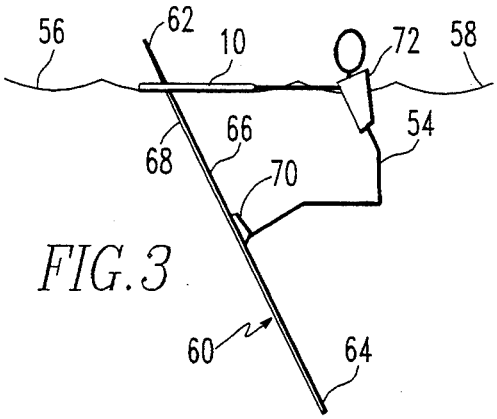
FIGS. 3–7 are schematic side views of the device of the present invention being used by a water skier which illustrate the method of using this device.
Figure 4:
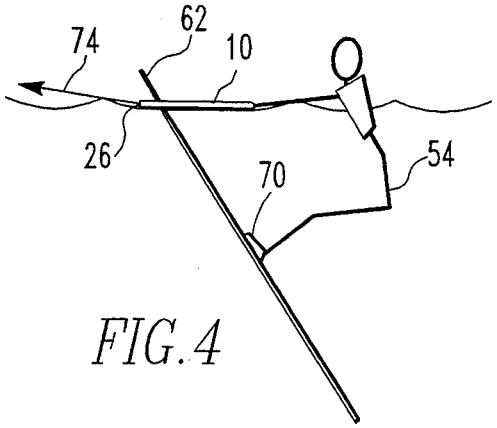
Figure 5:
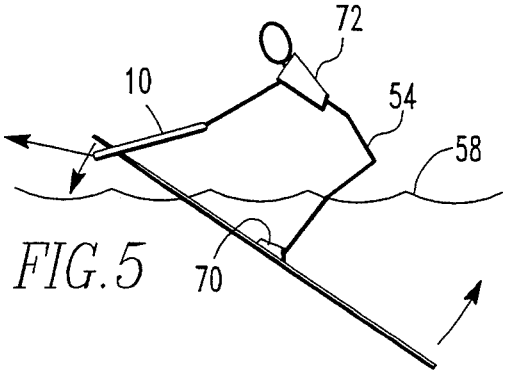
Figure 6:
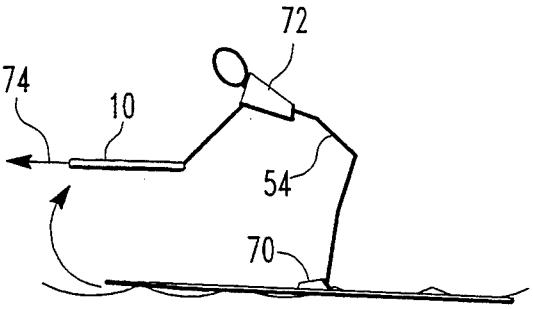
Figure 7:
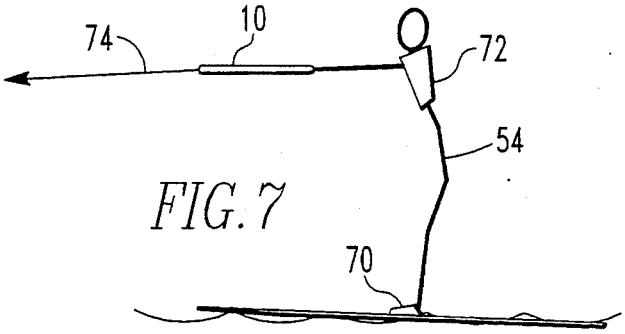

Referring to FIGS. 3–7, a method for using the above described device is illustrated. Referring particularly to FIG. 3, a water skier 54 equipped with water skis is shown in the conventional semi-submerged motionless starting position at the surface 56 of a body of water of water 58. One of the skier's two skis is shown generally at numeral 60, and that ski has a front terminal end 62 and a rear terminal end 64 and a top side 66 and bottom side 68 with a foot retaining stirrup 70 being positioned on said top side. As is conventional, the skier is also equipped with a life vest 72 and engages the stirrups on each of his skis with one of his feet. In order to use the disclosed device to progress from this stationary semi-submerged starting position to an upright moving skiing position the user engages the front terminal end of the ski with the forward ski retaining member 10 so that the lower side of the ski bears against the ski pivoting surface rear surface 20 of the front bar 16 and the upper terminal end of the ski protrudes above the water surface and the lower terminal end and the foot retaining stirrup is below the water surface. The skier maintains manual control of the ski retaining means from a fixed distance by manually gripping the rearward handle member 12 at the handle bar 40, which as was disclosed above, is rigidly connected to the ski retaining means by the longitudinal support member 14. Referring particularly to FIG. 4, the skier with assistance of a power boat (not shown) connected to the ring 26 by a ski line shown in fragment at 74 causes a forwardly directed force to be applied to the forward ski retaining member. As is shown particularly in FIG. 5, the skier then allows the lower side of the ski to pivot on the ski pivoting surface of the ski retaining means such that the front terminal end of the ski rotates downwardly toward the water surface and the rear terminal rotates upwardly toward the water surface. As is shown particularly in FIG. 6, when the skis approach a position in which they approach being plane with the water surface, the user may easily disengage the front terminal end of the skis from the ski retaining means. Finally, as is shown in FIG. 7, after the skis are disengaged from the ski retaining member, the forward force on the ski line will bring the user to the conventional approximately upright skiing position. It will be understood that the foregoing described method may be employed by a skier using either one ski or two.

It will be appreciated that the device of the present invention affords numerous advantages including the fact that it includes no moveable parts and that it can be engaged and disengaged from a ski or pair of skis without need of mechanical fasteners. In fact, as has been demonstrated above, the device will be locked onto the skis and then disengaged from the skis largely, if not completely, by means of the forces resulting from the force of a power boat pulling on the device in the normal course of skiing.

Although the invention has been described with a certain degree of particularity, it will be understood that this disclosure has been made only as an example, and that the scope of the invention is defined by the following claims.

What is claimed is:

1. A device for use in training water skiers comprising:

(a) a forward ski retaining member having a ski pivoting surface and said skiing member comprising:

(i) a rigid front bar having a front surface and a rear surface which rear surface forms the ski pivoting surface; and (ii) a rigid recessed bar member longitudinally displaced behind the rigid front bar to form with said rigid front bar a ski retaining slot and wherein the rigid front bar and the rigid recessed bar both have first and second lateral ends;

(b) a rearward handle member;

(c) a rigid longitudinal support means connecting the forward ski retaining member and the rearward handle member, said longitudinal support means comprising a first lateral bar and a second lateral bar which first lateral bar extends rearwardly from the first lateral end of the rigid front bar to the first lateral end of the recessed bar to the handle member and which second lateral bar extends rearwardly from the second lateral end of the rigid front bar to the second lateral end of the recessed bar to the handle member; and

2. The device of claim 1 Wherein the ski pivoting surface is generally convexly shaped to be adapted to allow at least one water ski to be pivoted through a vertical arc thereon.

3. The device of claim 1 wherein the rigid longitudinal support means is from about 20 inches to about 36 inches in length.

4. The device of claim 1 herein there is a means for exerting a forwardly directed force on the forward ski retaining member.

5. The device of claim 1 wherein a ski line connecting ring extends forwardly from the front surface of the rigid front bar.

6. The device of claim 1 wherein the handle member is equipped with a pair of bicycle grips.

7. The device of claim 1 wherein the reinforcing member comprises a first and a second flattened trapezoidially shaped members which extend inwardly toward each other respectfully from the first and second lateral bars and which are connected by a centrally positioned flattened rectangular member.

8. The device of claim 1 wherein said from bar and the first and Second lateral bars and the handle member are tubular in shape.

9. The device of claim 8 wherein the front bar and the first and second lateral bars and the handle member have an outer diameter of from about 1 inch to about 2 inches and a inner diameter of from about ¾ inch to about 1½ inches.

10. The device of claim 9 wherein the front bar and the first and second lateral bars and the handle member are tubular plastic.

11. The device of claim 9 wherein the front bar and the first and second lateral bars and the handle member are tubular aluminum.

12. The device of claim 1 wherein the ski retaining slot has a longitudinal dimension of from about ½ inch to about 1½ inches.

13. The device of claim 12 wherein the ski retaining slot has a transverse dimension of from about 16 inches to about 48 inches.

* * * * *